US007004323B1

(12) United States Patent
Symonds

(10) Patent No.: US 7,004,323 B1
(45) Date of Patent: Feb. 28, 2006

(54) LUNCH BOX WITH DIVIDER STRUCTURE

(76) Inventor: Theresa H. Symonds, 49 Woodstone Rd., Basking Ridge, NJ (US) 07920

( * ) Notice: Subject to any disclaimer, the term of this patent is extended or adjusted under 35 U.S.C. 154(b) by 30 days.

(21) Appl. No.: 10/776,047

(22) Filed: Feb. 12, 2004

(51) Int. Cl.
*A45C 11/20* (2006.01)
*B65D 25/04* (2006.01)

(52) U.S. Cl. ..... 206/542; 220/533; 426/120

(58) Field of Classification Search ..... 206/541–542, 206/545–550; 220/532–533, 541–542; 426/110, 426/119–120; 190/110
See application file for complete search history.

(56) References Cited

U.S. PATENT DOCUMENTS

| | | | | | |
|---|---|---|---|---|---|
| 598,801 | A | | 2/1898 | Minter | |
| 1,554,077 | A | * | 9/1925 | Fay | 426/119 |
| 1,674,352 | A | * | 6/1928 | Adams | 220/533 |
| 2,011,996 | A | * | 8/1935 | Belk | 206/549 |
| 2,061,965 | A | | 11/1936 | Graeser | |
| 2,496,296 | A | | 2/1950 | Lobl | |
| 2,672,232 | A | | 3/1954 | Kessell, Jr. | |
| 3,079,028 | A | * | 2/1963 | Rosner | 220/532 |
| 3,381,782 | A | * | 5/1968 | Ikelheimer | 220/533 |
| 3,432,025 | A | | 3/1969 | Luhe | |
| 3,491,909 | A | * | 1/1970 | Ikelheimer | 220/533 |
| 3,859,819 | A | | 1/1975 | Kaplan | |
| 4,260,004 | A | * | 4/1981 | Domke | 190/110 |
| 4,842,032 | A | * | 6/1989 | Mastronardo | 190/110 |
| D302,904 | S | | 8/1989 | Dunkeld, Jr. | |
| 4,932,548 | A | * | 6/1990 | Bensinger | 220/533 |
| 5,103,998 | A | * | 4/1992 | Caro et al. | 220/533 |
| 5,244,268 | A | * | 9/1993 | Derrickson | 206/545 |
| 5,501,338 | A | | 3/1996 | Preston | |
| D371,056 | S | | 6/1996 | Sullivan | |
| 6,910,560 | B1 | * | 6/2005 | Dulin | 190/110 |

* cited by examiner

*Primary Examiner*—Bryon P. Gehman

(57) ABSTRACT

A lunch box includes a housing that has top and bottom surfaces. The housing further has sidewalls integral with the bottom surface and preferably extending upwardly therefrom. Support members are secured to the plurality of sidewalls. The divider plates are removably attachable to the support members. A divider bar is slidably positionable into corresponding slots on the divider plates. The divider bar also has slots formed along a length thereof. Divider members have a plurality of slots formed therein for selectively engaging the divider bar. The divider bar and the plurality of divider members advantageously cooperate with each other for maintaining food products during transportation. The lunch box further has a zipper for attaching the top surface to the housing. A flexible handle is also connected to the housing.

18 Claims, 4 Drawing Sheets

LUNCH BOX WITH DIVIDER STRUCTURE

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to a lunch box and, more particularly, to a lunch box containing a plurality of storage dividers for separating food products positioned therein.

2. Prior Art

Numerous manufacturers have provided food carriers (commonly known as "lunch boxes"), designed and marketed specifically for children, and for the manual laborer, or so-called "blue collar" worker. In addition, many other kinds of people also carry food to their places of work, or elsewhere, using a plain paper bag.

One common shortcoming of prior art lunch boxes is their inability to effectively separate food products. For example, a user often carries soft sandwiches and rigid soda cans in his or her lunch box. During transportation, such items moved around and press against each other as the lunch box is repetitively repositioned. Consequently, some of the softer food products become damaged thereby causing their ingredients to ooze in the lunch box and become contaminated and uneatable.

Accordingly, a need remains for a lunch box that contains storage dividers for overcoming the above-noted shortcomings.

BRIEF SUMMARY OF THE INVENTION

In view of the foregoing background, it is therefore an object of the present invention to provide a lunch box for separating food products contained therein. These and other objects, features, and advantages of the invention are provided by a lunch box including a housing that has a centrally disposed longitudinal axis and generally planar top and bottom surfaces. The housing further has a plurality of sidewalls integral with the bottom surface and preferably extending upwardly therefrom in a substantially vertical direction.

The present invention further has a plurality of oppositely disposed support members secured to select ones of the plurality of sidewalls. The plurality of support members have top and bottom edges extending substantially orthogonal to the axis and substantially parallel to the select sidewalls.

The lunch box further includes a plurality of divider plates that have rear surfaces removably attachable to the plurality of support members respectively. Advantageously, such divider plates may be removed from the lunch box when a user desires to employ the lunch box in a conventional manner. The plurality of divider plates further have front surfaces including a plurality of oppositely facing appendages selectively spaced therealong and extending outwardly therefrom at a substantially parallel direction to the axis respectively. The plurality of appendages selectively define a plurality of slots therebetween. The plurality of divider plate slots may extend downwardly along a substantially vertical path for receiving and maintaining the plurality of divider members at corresponding vertical directions.

The present invention further includes an elongated divider bar that may be slidably positionable into corresponding ones of the plurality of slots for defining a first plurality of cavities within the housing. The divider bar may also have a plurality of slots formed along a length thereof.

The lunch box further includes a plurality of divider members including elongated bodies and top and bottom edge portions spaced apart from each other. Such divider members have a plurality of slots formed therein for selectively engaging the divider bar so that the first plurality of cavities may be subdivided into a second plurality of cavities within the housing. The divider bar and the plurality of divider members advantageously cooperate with each other for receiving and selectively maintaining a plurality of food products within the plurality of first and second cavities during transportation thereof. Of course, a user may selectively adjust the size and arrangement of such cavities as required for his/her particular application.

The plurality of divider member slots may extend upwardly from the bottom edge portions and terminate generally medially between the bottom and top edge portions respectively. The plurality of divider member slots may also extend along a substantially vertical direction so that same may be selectively positioned along a length of the divider bar and between the plurality of divider plates. The plurality of divider members further comprise a plurality of end portions integral with the plurality of bodies respectively and may be spaced from the plurality of associated slots thereof.

Such a plurality of end portions define a plurality of stop portions for preventing the plurality of divider members from transversely moving beyond the divider bar. The plurality of divider members, the plurality of divider plates, and the divider bar may be formed from plastic or other suitable materials, well-known to a person of ordinary skill in the art.

The present invention may further include a zipper for selectively attaching the top surface to the housing. A flexible handle having opposed end portions may also be connected to the housing for allowing a user to maintain a secure grip of the lunch box.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
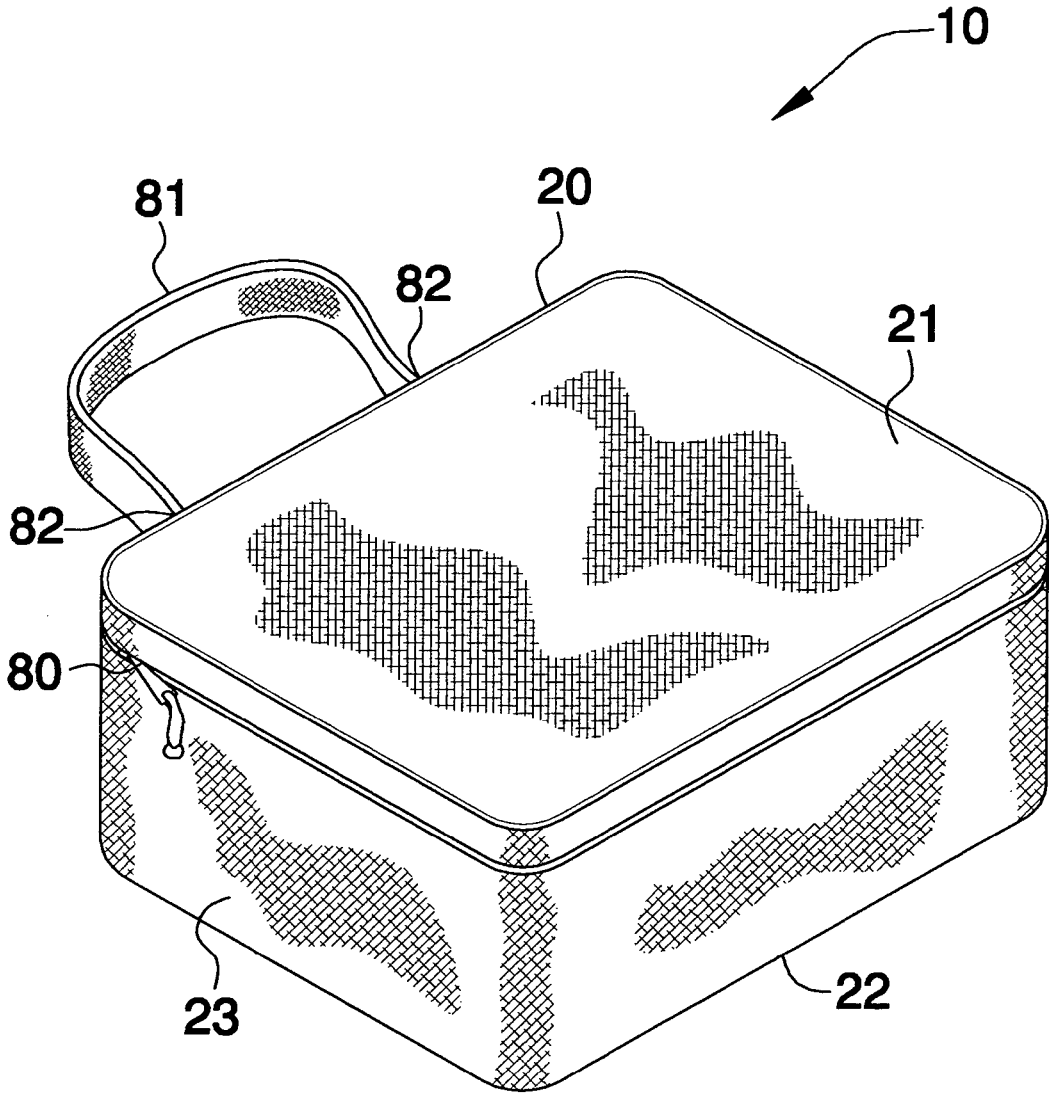
FIG. 1 is a perspective view showing a lunch box, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The apparatus of this invention is referred to generally in FIGS. 1–4 by the reference numeral 10 and is intended to provide a lunch box containing a plurality of storage dividers for separating food products positioned therein. It should be understood that the apparatus 10 may be used to protect many different food items contained therein.

Referring initially to FIG. 1, the present invention includes a housing 20 that has a centrally disposed longitudinal axis and generally planar top 21 and bottom 22 surfaces. The housing 20 further has a plurality of sidewalls 23 integral with the bottom surface 22 and preferably extending upwardly therefrom in a substantially vertical direction.

Figure 2:
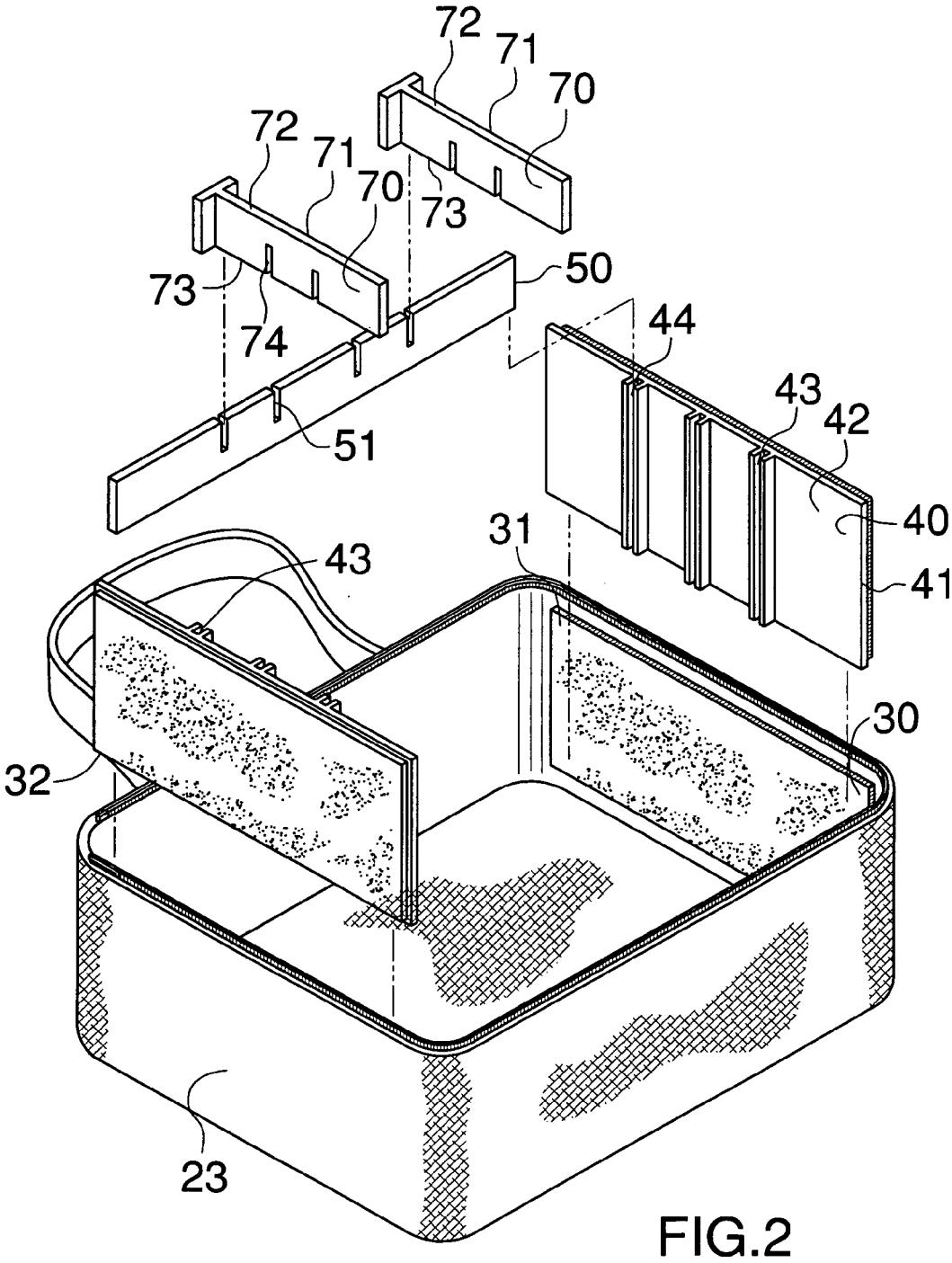
FIG. 2 is an exploded perspective view of the lunch box shown in FIG. 1.

Now referring to FIG. 2, the present invention further has a plurality of oppositely disposed support members 30 secured to select ones of the plurality of sidewalls 23. The plurality of support members 30 have top 31 and bottom 32 edges extending substantially orthogonal to the axis and substantially parallel to the select sidewalls 23. The lunch box further includes a plurality of divider plates 40 that have rear surfaces 41 removably attachable to the plurality of support members 30 respectively.

Advantageously, such divider plates 40 may be removed from the lunch box when a user desires to employ the lunch box in a conventional manner. The plurality of divider plates 40 further have front surfaces 42 including a plurality of oppositely facing appendages 43 selectively spaced therealong and extending outwardly therefrom at a substantially parallel direction to the axis respectively. The plurality of appendages 43 selectively define a plurality of slots 44 therebetween. The plurality of divider plate slots 44 extend downwardly along a substantially vertical path for receiving and maintaining the plurality of divider members 50 at corresponding vertical directions.

Figure 4:
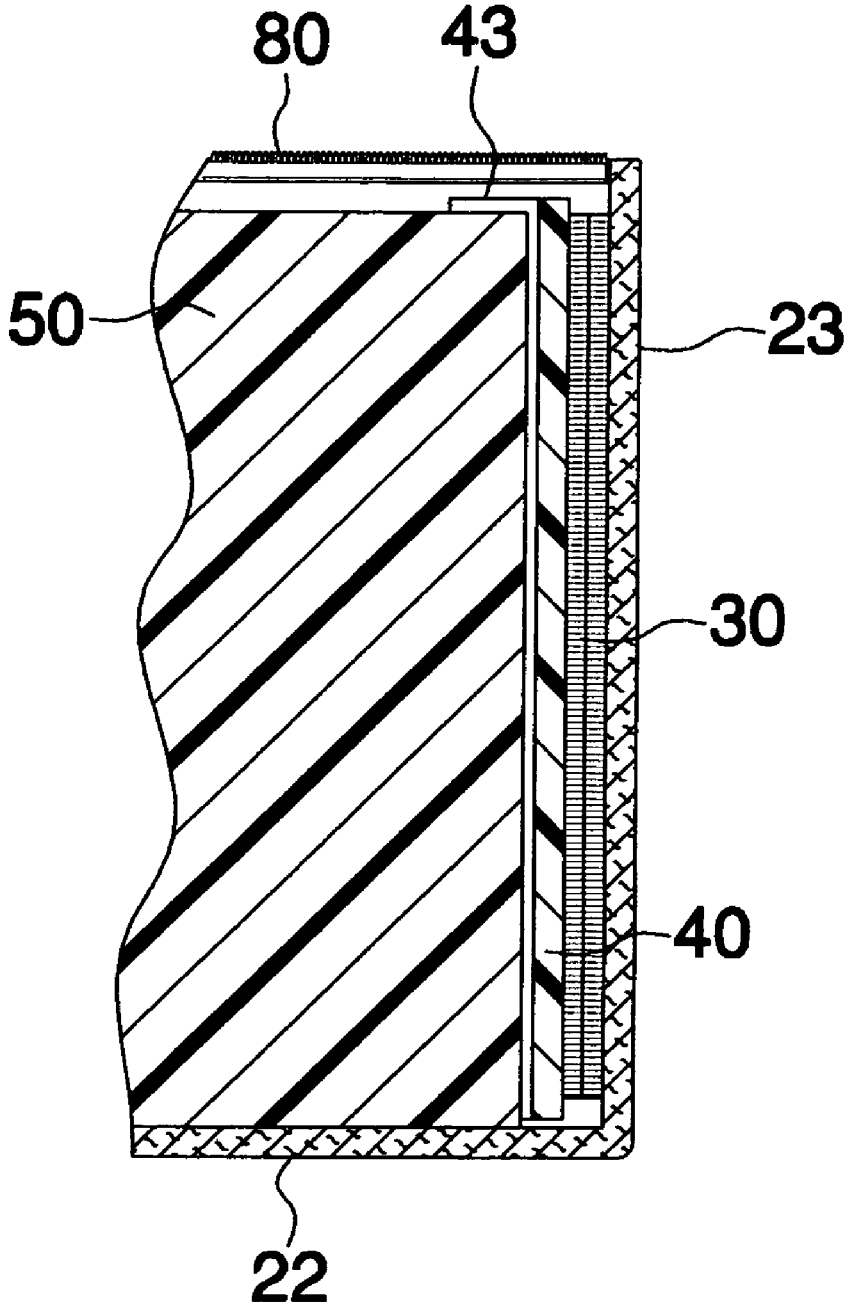
FIG. 4 is an enlarged cross-sectional view of FIG. 3, taken along line 4—4.

The present invention further includes an elongated divider bar 50 that is slidably positionable into corresponding ones of the plurality of slots 44 for defining a first plurality of cavities within the housing 20, as best shown in FIG. 4. The divider bar 50 also has a plurality of slots 51 formed along a length thereof, as best shown in FIG. 2.

The lunch box further includes a plurality of divider members 70 including elongated bodies 71 and top 72 and bottom 73 edge portions spaced apart from each other. Such a divider member 70 has a plurality of slots 74 formed therein for selectively engaging the divider bar 50 so that the first plurality of cavities is subdivided into a second plurality of cavities within the housing 20, as best shown in FIG. 2. The divider bar 50 and the plurality of divider members 70 advantageously cooperate with each other for receiving and selectively maintaining a plurality of food products within the plurality of first and second cavities during transportation thereof. Of course, a user may selectively adjust the size and arrangement of such cavities as required for his/her particular application.

The plurality of divider member slots 74 extend upwardly from the bottom edge portions 73 and terminate generally medially between the bottom 73 and top 72 edge portions respectively. The plurality of divider member slots 74 also extend along a substantially vertical direction so that same may be selectively positioned along a length of the divider bar 50 and between the plurality of divider plates 40. The plurality of divider members 70 further comprise a plurality of end portions 75 integral with the plurality of bodies 71 respectively and are spaced from the plurality of associated slots 51 thereof.

Figure 3:
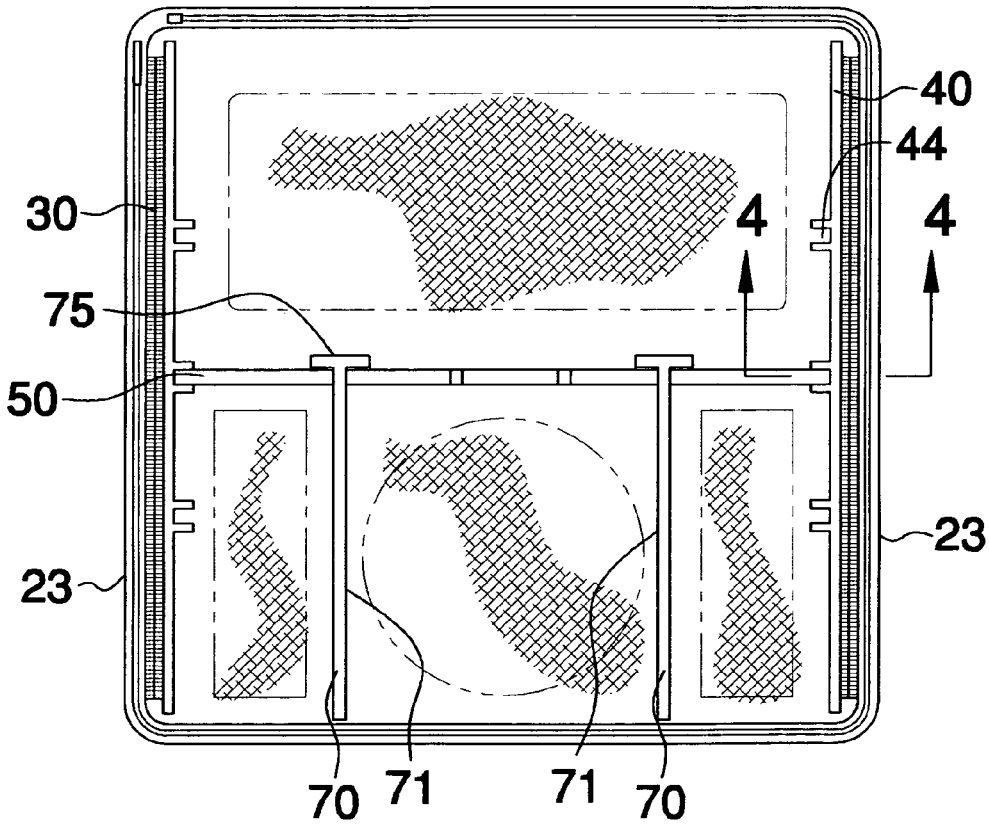
FIG. 3 is a top plan view of the lunch box shown in FIG. 1.

Such a plurality of end portions 75 define a plurality of stop portions for preventing the plurality of divider members 70 from transversely moving beyond the divider bar 50, as best shown in FIG. 3. The plurality of divider members 70, the plurality of divider plates 40, and the divider bar 50 are formed from plastic or other suitable materials, well-known to a person of ordinary skill in the art.

The present invention further includes a zipper 80 for selectively attaching the top surface 21 to the housing 20. A flexible handle 81 having opposed end portions 82 is also connected to the housing 20 for allowing a user to maintain a secure grip of the lunch box.

The versatile lunch box could appeal to a wide range of individuals who carry their lunch to school or work. The removable separator allows a variety of foods to be kept in separate sections of the lunch box. As a result, food arrives at school or work undamaged, as well as more appealing and appetizing.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A lunch box for isolating food products therein, said lunch box comprising:

a housing having a centrally disposed longitudinal axis and a generally planar top surface, said housing further having a generally planar bottom surfaces, said housing further having a plurality of sidewalls integral with said bottom surface and extending upwardly therefrom in a substantially vertical direction;

a plurality of oppositely disposed support members secured to select ones of said plurality of sidewalls, said plurality of support members having top and bottom edges extending substantially orthogonal to the axis and substantially parallel to said select sidewalls;

a plurality of divider plates having rear surfaces removably attachable to said plurality of support members respectively, said plurality of divider plates further having front surfaces including a plurality of oppositely facing appendages selectively spaced therealong and extending outwardly therefrom at a substantially parallel direction to the axis respectively, said plurality of appendages selectively defining a plurality of slots therebetween;

an elongated divider bar being slidably positionable into corresponding ones of said plurality of slots and for defining a first plurality of cavities within said housing, said divider bar having a plurality of slots formed along a length thereof, and a plurality of divider members including elongated bodies having a plurality of slots formed therein respectively and for being selectively engaged with said divider bar so that the first plurality of cavities can be subdivided into a second plurality of cavities within said housing, said divider bar and said plurality of divider members cooperating with each other for receiving and selectively maintaining a plurality of food products within the plurality of first and second cavities during transportation thereof.

2. The lunch box of claim 1, wherein said plurality of divider members further have top and bottom edge portions spaced apart from each other, said plurality of divider member slots extending upwardly from said bottom edge portions and terminating generally medially between said bottom and top edge portions respectively.

3. The lunch box of claim 1, wherein said plurality of divider member slots extend along a substantially vertical direction so that said plurality of divider members can be selectively positioned along a length of said divider bar and between said plurality of divider plates.

4. The lunch box of claim 1, wherein said plurality of slots of said plurality of appendages extend downwardly along a substantially vertical path for receiving and maintaining said plurality of divider members at corresponding vertical directions.

5. The lunch box of claim 1, wherein said plurality of divider members further comprise: a plurality of end portions integral with said plurality of bodies respectively and being spaced from said plurality of slots formed within said plurality of bodies, said plurality of end portions defining a plurality of stop portions for preventing said plurality of divider members from transversely moving beyond said divider bar.

6. The lunch box of claim 1, wherein said plurality of divider members and said plurality of divider plates and said divider bar are formed from plastic.

7. The lunch box of claim 1, further comprising:

a zipper for selectively attaching said top surface to said housing; and a flexible handle having opposed end portions connected to said housing and for allowing a user to maintain a secure grip of said lunch box.

8. A lunch box for isolating food products therein, said lunch box comprising:

a housing having a centrally disposed longitudinal axis and a generally planar top surface, said housing further having a generally planar bottom surfaces, said housing further having a plurality of sidewalls integral with said bottom surface and extending upwardly therefrom in a substantially vertical direction;

a plurality of oppositely disposed support members secured to select ones of said plurality of sidewalls, said plurality of support members having top and bottom edges extending substantially orthogonal to the axis and substantially parallel to said select sidewalls;

a plurality of divider plates having rear surfaces removably attachable to said plurality of support members respectively, said plurality of divider plates further having front surfaces including a plurality of oppositely facing appendages selectively spaced therealong and extending outwardly therefrom at a substantially parallel direction to the axis respectively, said plurality of appendages selectively defining a plurality of slots therebetween;

an elongated divider bar being slidably positionable into corresponding ones of said plurality of slots and for defining a first plurality of cavities within said housing, said divider bar having a plurality of slots formed along a length thereof; and a plurality of divider members including elongated bodies having a plurality of slots formed therein respectively and for being selectively engaged with said divider bar so that the first plurality of cavities can be subdivided into a second plurality of cavities within said housing, said divider bar and said plurality of divider members cooperating with each other for receiving and selectively maintaining a plurality of food products within the plurality of first and second cavities during transportation thereof, said plurality of divider members further having top and bottom edge portions spaced apart from each other, said plurality of divider member slots extending upwardly from said bottom edge portions and terminating generally medially between said bottom and top edge portions respectively.

9. The lunch box of claim 8, wherein said plurality of divider member slots extend along a substantially vertical direction so that said plurality of divider members can be selectively positioned along a length of said divider bar and between said plurality of divider plates.

10. The lunch box of claim 8, wherein said plurality of slots of said plurality of appendages extend downwardly along a substantially vertical path for receiving and maintaining said plurality of divider members at corresponding vertical directions.

11. The lunch box of claim 8, wherein said plurality of divider members further comprise: a plurality of end portions integral with said plurality of bodies respectively and being spaced from said plurality of slots formed within said plurality of bodies, said plurality of end portions defining a plurality of stop portions for preventing said plurality of divider members from transversely moving beyond said divider bar.

12. The lunch box of claim 8, wherein said plurality of divider members and said plurality of divider plates and said divider bar are formed from plastic.

13. The lunch box of claim 8, further comprising:

a zipper for selectively attaching said top surface to said housing; and a flexible handle having opposed end portions connected to said housing and for allowing a user to maintain a secure grip of said lunch box.

14. A lunch box for isolating food products therein, said lunch box comprising:

a housing having a centrally disposed longitudinal axis and generally planar top surface, said housing further having a generally planar bottom surfaces, said housing further having a plurality of sidewalls integral with said bottom surface and extending upwardly therefrom in a substantially vertical direction;

a plurality of oppositely disposed support members secured to select ones of said plurality of sidewalls, said plurality of support members having top and bottom edges extending substantially orthogonal to the axis and substantially parallel to said select sidewalls;

a plurality of divider plates having rear surfaces removably attachable to said plurality of support members respectively, said plurality of divider plates further having front surfaces including a plurality of oppositely facing appendages selectively spaced therealong and extending outwardly therefrom at a substantially parallel direction to the axis respectively, said plurality of appendages selectively defining a plurality of slots therebetween;

an elongated divider bar being slidably positionable into corresponding ones of said plurality of slots and for defining a first plurality of cavities within said housing, said divider bar having a plurality of slots formed along a length thereof; and a plurality of divider members including elongated bodies having a plurality of slots formed therein respectively and for being selectively engaged with said divider bar so that the first plurality of cavities can be subdivided into a second plurality of cavities within said housing, said divider bar and said plurality of divider members cooperating with each other for receiving and selectively maintaining a plurality of food products within the plurality of first and second cavities during transportation thereof, said plurality of divider members further having top and bottom edge portions spaced apart from each other, said plurality of divider member slots extending upwardly from said bottom edge portions and terminating generally medially between said bottom and top edge portions respectively, said plurality of divider member slots extending along a substantially vertical direction so that said plurality of divider members can be selectively positioned along a length of said divider bar and between said plurality of divider plates.

15. The lunch box of claim 14, wherein said plurality of slots of said plurality of appendages extend downwardly along a substantially vertical path for receiving and maintaining said plurality of divider members at corresponding vertical directions.

16. The lunch box of claim 14, wherein said plurality of divider members further comprise: a plurality of end portions integral with said plurality of bodies respectively and being spaced from said plurality of slots formed within said plurality of bodies, said plurality of end portions defining a plurality of stop portions for preventing said plurality of divider members from transversely moving beyond said divider bar.

17. The lunch box of claim 14, wherein said plurality of divider members and said plurality of divider plates and said divider bar are formed from plastic.

18. The lunch box of claim 14, further comprising:

a zipper for selectively attaching said top surface to said housing; and a flexible handle having opposed end portions connected to said housing and for allowing a user to maintain a secure grip of said lunch box.

* * * * *